US007467606B2

(12) United States Patent
Jurisic

(10) Patent No.: US 7,467,606 B2
(45) Date of Patent: Dec. 23, 2008

(54) ELLIPTICAL ROTARY MOTOR WITH INTERNAL COMBUSTION

(75) Inventor: Vojislav Jurisic, Brace Savic 3, 11273 Batanjnica, Serbia and Montenegro (YU)

(73) Assignee: Vojislav Jurisic, Belgrade (RS)

( * ) Notice: Subject to any disclaimer, the term of this patent is extended or adjusted under 35 U.S.C. 154(b) by 0 days.

(21) Appl. No.: 10/598,099

(22) PCT Filed: Feb. 10, 2005

(86) PCT No.: PCT/IB2005/001018

§ 371 (c)(1),
(2), (4) Date: Aug. 17, 2006

(87) PCT Pub. No.: WO2005/080768

PCT Pub. Date: Sep. 1, 2005

(65) Prior Publication Data

US 2007/0131179 A1 Jun. 14, 2007

(30) Foreign Application Priority Data

Feb. 18, 2004 (YU) ..... 143/04

(51) Int. Cl.

| | |
|---|---|
| ***F02B 57/00*** | (2006.01) |
| ***F02B 75/26*** | (2006.01) |
| ***F02B 53/00*** | (2006.01) |
| ***F02B 57/08*** | (2006.01) |
| ***F01B 13/04*** | (2006.01) |
| ***F01B 13/06*** | (2006.01) |

(52) U.S. Cl. ..... 123/43 R; 123/43 C; 123/44 E; 123/18 R

(58) Field of Classification Search ..... 123/43 R, 123/43 C, 44 R, 44 C, 44 D, 44 E, 18 R
See application file for complete search history.

(56) References Cited

U.S. PATENT DOCUMENTS

| | | | | | |
|---|---|---|---|---|---|
| 618,157 | A | * | 1/1899 | Wolf | 123/43 R |
| 1,341,332 | A | * | 5/1920 | McDonald | 123/43 R |
| 1,766,385 | A | * | 6/1930 | Jackson | 123/43 C |
| 1,918,174 | A | * | 7/1933 | Berggren | 123/18 R |
| 1,990,660 | A | * | 2/1935 | McCann | 123/44 E |
| 2,036,060 | A | * | 3/1936 | Lewis | 123/44 E |
| 2,244,438 | A | * | 6/1941 | Wilkerson | 123/43 R |
| 3,391,678 | A | * | 7/1968 | Luckhardt | 123/204 |
| 3,931,810 | A | * | 1/1976 | McGathey | 123/44 E |

FOREIGN PATENT DOCUMENTS

DE 859694 * 12/1952

* cited by examiner

*Primary Examiner*—Thai-Ba Trieu

(57) ABSTRACT

A method and an apparatus include a motor housing (1), an internal space cylindrical rotor (2) rotating together with radial placed work cylinder (3) and piston (6), a connecting rod (7) and a connecting axle (9) connected with oscillating lever (8), and a pin (10) to transfer rotary moment to the internal space cylindrical rotor (2), and output shafts (17) and (20). Simultaneously, connecting rod (7), via connecting axle (9) by its own motion, moves satellite gears (12), which off-center mounted swinging bearing rings (13) and symmetrically geared to off-center mounted inner tooth gears (11), define position of radial placed work cylinder (3) being relative to two outer dead centers and two inner dead centers.

3 Claims, 6 Drawing Sheets

ELLIPTICAL ROTARY MOTOR WITH INTERNAL COMBUSTION

CROSS-REFERENCE TO RELATED APPLICATIONS

This application claims benefit of Serbian patent application serial number P-143/04, filed Feb. 18, 2004, which is herein incorporated by reference.

BACKGROUND OF THE INVENTION

Field of the Invention

Invention is from the field of piston internal combustion engines, or closer engines with rotary pistons. By International Patent Classification, (ICP) it belongs to group F 02B 53/00.

SUMMARY OF THE INVENTION

Core of this invention is:

- efficient elimination of all products of combustion from radial placed work cylinder of the motor in the exhaust stroke.
- improved charge of the radial placed work cylinder by fuel-air mixture; fuel-air mixture does not mix with residual products of combustion from the previous cycle.
- different piston stroke in individual strokes of the work cycle.
- different angle of rotation for individual strokes of the work cycle therefore it allows different time of duration of individual strokes of the work cycle.
- selection of optimal change of displacement of the work chamber relative to the change of angle of rotation of internal space cylindrical rotor which is exceptionally important during combustion process; it allows necessary time for completion of the process of combustion under optimum condition.
- different compression ratio and expansion ratio of work cycle meaning greater expansion ratio relative to compression ratio making possible extended expansion of products of combustion.
- increase of compression ration or expansion ratio of work cycle.
- improvement of quality of combustion and quality of emission.
- greater thermodynamic coefficient of efficiency of the work cycle of the motor.
- more even operation of the motor.
- reduction of the lateral force pressing piston against wall of the radial placed work cylinder.
- reduction of mechanical loses.
- completion of entire work cycle in one rotation of the elliptical rotary motor, which means completion of all four stroke in 360 degree of rotation of the main elliptical rotary motor shaft.

BRIEF DESCRIPTION OF DRAWINGS

So that the manner in which the above recited features of the present invention can be understood in detail, a more particular description of the invention, briefly summarized above, may be had by referenced to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Figure 1:
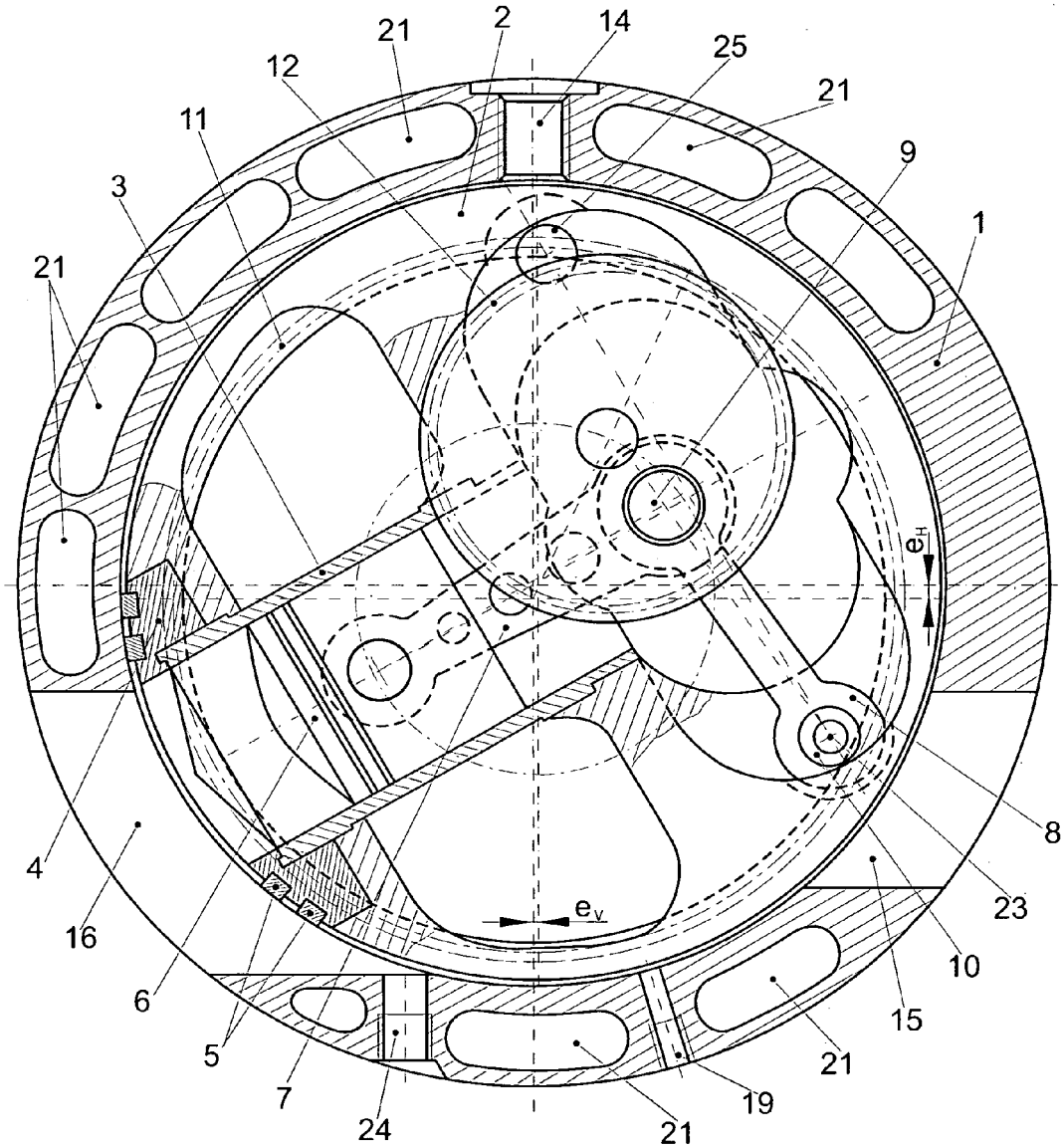
FIG. 1. Shows front view cross section of elliptical rotary motor.
Figure 2:
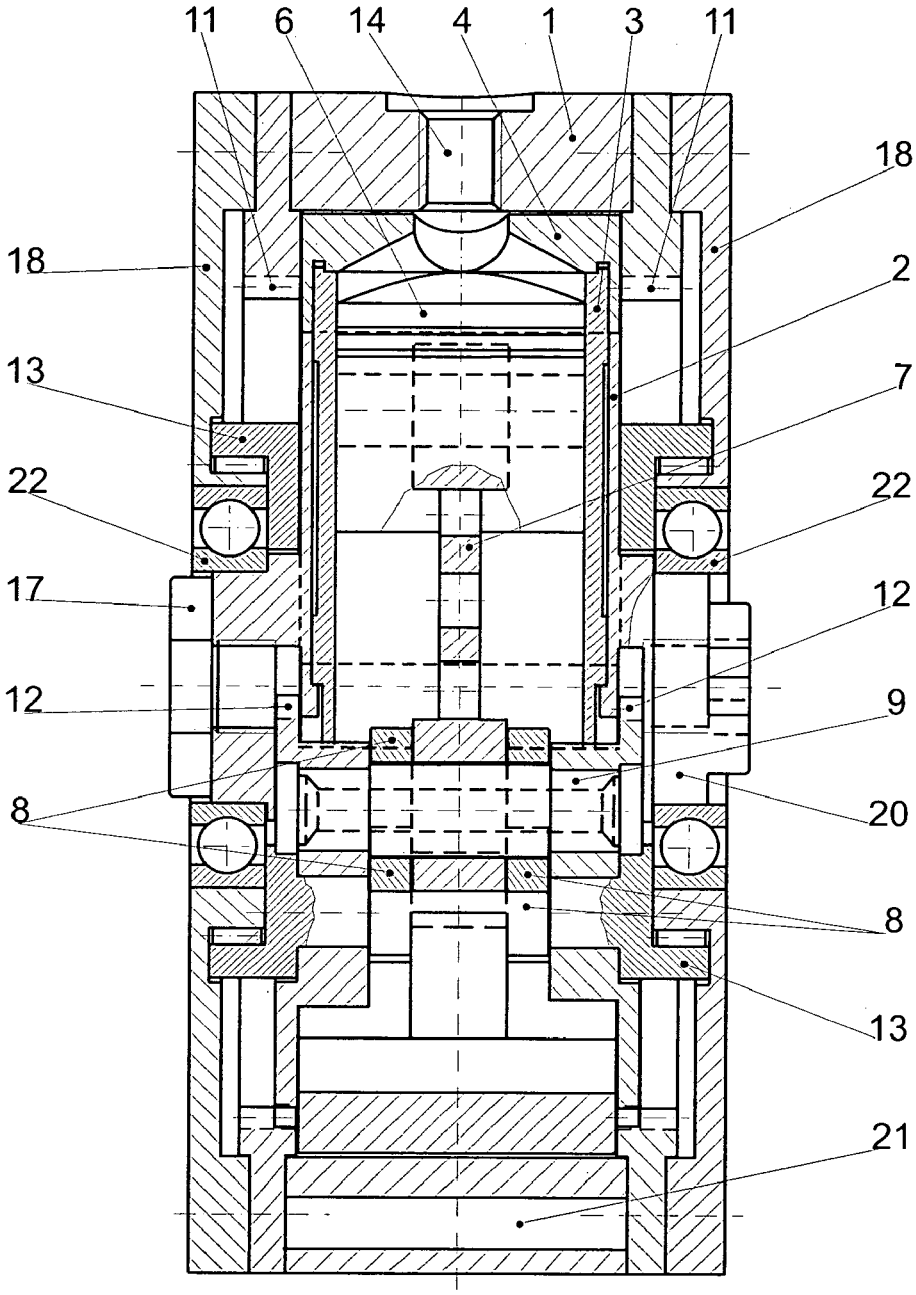
FIG. 2. Shows side view cross section of elliptical rotary motor FIG. 3. Shows principal schematic of action within elliptical rotary motor.

FIGS. 1 and 2 show that in cylindrical ring shaped inner space of housing motor (1) is internal space cylindrical rotor (2), inside it is radial placed work cylinder (3) and in radial placed work cylinder (3) is piston (6). On the upper side of radial placed work cylinder (3), as its extension in its longitudinal axis is located work cylinder cap (4) with opening in the middle. Under the gas force or the force created by combustion of fuel in the work chamber of radial placed work cylinder (3) (that is space between piston (6) dome and inner cylindrical surface of motor housing (1), piston (6), which is via its piston pin connected to the connecting rod (7) and following that via other end of connecting rod (7) connected with connecting axle (9), moves towards left inner dead center (LIDC) with simultaneous rotation of internal space cylindrical rotor (2).

Oscillating lever (8) on one of its ends has shackle whose both openings are connected by connecting axle (9) and via it with end of connecting rod (7) so that inner sides of shackle are located to the left and right of connecting rod (7). On its other end oscillating lever (8) has opening which is via pin (10) connected to the opening (23) which is located in internal space cylindrical rotor (2) (but which instead opening (23) can also be connected with opening (25) which is also located in the internal space cylindrical rotor (2)). That way oscillating lever (8) transfers to the internal space cylindrical rotor (2) gas force created by combustion of fuel in expansion stroke in work chamber of radial placed work cylinder (3). Gas force relative to the center of the internal space cylindrical rotor (2) creates torque which results in rotation of internal space cylindrical rotor (2) around its axis. In the remaining strokes (exhaust, intake, compression) rotation from internal space cylindrical rotor (2) due to momentum, with help of flywheel located outside of elliptical rotary motor, transfers via oscillating lever (8) and connecting axle (9) to the piston (6).

FIG. 1 shows counterclockwise rotation of internal space cylindrical rotor (2) and in that case oscillating lever (8) "pulls" internal space cylindrical rotor (2) behind it. When other opening of oscillating lever (8) is switched from opening (23) of internal space cylindrical rotor (2) to opening (25) also located in internal space cylindrical rotor (2) and connected via pin (10) then oscillating lever (8) "pushes" internal space cylindrical rotor (2) in front of it. Selection of one or the other opening (23) or (25) achieves different mode of change of displacement of work chamber of radial placed work cylinder (3) as a function of angle of rotation of internal space cylindrical rotor (2) and with that we achieve different mode of transfer of gas force and also different mode of change of torque of internal space cylindrical rotor (2).

Gear mechanism consists of two satellite gears (12) which, via openings which are displaced from their centers, are mutually parallel connected by connecting axle (9). Satellite gears (12) are geared to two inner tooth gears (11) which are offset by eccentricity $e_h$ and $e_v$ relative to the center of rotation of internal space cylindrical rotor (2) and in a ratio i=2. Depending upon distance between their longitudinal axes and axis of opening in which they are connected to connecting axle (9), directly depends stroke of piston (6) and displacement of work chamber of radial placed work cylinder (3). Satellite gears (12) are positioned relative to each other as in mirror image and are carried by swinging bearing rings (13) via sleeve. Abovementioned swinging bearing rings (13) are via bearings mounted to the hubs of deck-lids (18) and relative to longitudinal axis of deck-lids (18) are offset by the same eccentricities $e_h$ and $e_v$ as inner tooth gears (11). Because of mentioned ratio i=2, every point of satellite gears (12) (except their centers) during their rolling in each work cycle, which lasts 360 degrees, moves along imagined closed elliptic curve. That makes possible for new work cycle again to begin always from the same position of internal space cylindrical rotor (2) relative to motor housing (1) and also that motion along imagined ellipse makes possible to define during each work cycle position of piston (6) relative to the two outer dead centers (upper and lower ODC) and two inner dead centers (left and right IDC).

Entire gear mechanism functions as follows:

motion of piston (6) via connecting rod (7) transfers to the connecting axle (9) which is connected to satellite gears (12) causing their rolling along inner tooth gears (11). Simultaneously satellite gears (12) spin around their own axes and because swinging bearing rings (13) carry them via sleeves during their rolling and spinning relative to longitudinal axis of radial placed work cylinder (3) they also make relative oscillating motion as a pendulum. In other words from the vantage point on axes of radial placed work cylinder (3), during rotation of internal space cylindrical rotor (2) satellite gears (12) alternately appear on the left end right side of that axis. The length of that pendulum is defined by normal distance between longitudinal axis of swing rings (13) and axis of sleeve or that length is equal to half diameter of basic circle of satellite gear (12). Amplitude of those oscillations depends on mutual relation between half axes of above mentioned imagined ellipse as well as value of selected eccentricities $e_h$ and $e_v$. Angle speed of center of satellite gears (12) relative to center of rotation of internal space cylindrical rotor (2) when angle speed of internal space cylindrical rotor (2) is constant, changes during one work cycle. Shape and size of lower part of opening in internal space cylindrical rotor (2) where satellite gears (12) are located depend on amplitude of their oscillation. Torque from internal space cylindrical rotor (2), via shafts (17) and (20), and form integral internal space cylindrical rotor (2), and which rest on bearings (22), transfers outside motor.

Piston (6) has dome whose shape matches inner shape of work cylinder cap (4). When horizontal symmetrical axes of both inner tooth gears (11) move by the same value of eccentricity $e_h$ or by half of height of space between top of dome of piston (6) and inner surface of motor housing (1), when piston (6) relative to radial placed work cylinder (3) is in upper outer dead center (UODC) in position of initial displacement of work chamber—then thru opening (16), located in wall of motor housing (1), piston (6) at the end of exhaust stroke expels all residual products of combustion which previously have not left work chamber of radial placed work cylinder (3) (which is schematically shown in picture 3 when piston (6) is in lower outer dead center (LODC). That way in work chamber of radial placed work cylinder (3) there are no residual products of combustion from the cycle which just ended so that in intake stroke which immediately follows, in work displacement of radial placed work cylinder (3) where there is only mixture of fuel-air (or air only in diesel version of elliptical rotary motor).

All four work strokes are completed when internal space cylindrical rotor (2) spins 360 degrees around its longitudinal axis and when piston (6) is located two times in position of two upper dead center and two lower dead centers. Different duration of those work cycles and also mode of change of work displacement of radial placed work cylinder (3) as a function of change of that angle may occur because:

- of selection of different eccentricities $e_h$ and $e_v$
- of selection of different length of oscillating lever (8) and also by selection of different position of openings (23) or (25) located in internal space cylindrical rotor (2)
- of selection whether the other end of oscillating lever (8) is located in opening (23) of internal space cylindrical rotor (2) or in opening (25) of internal space cylindrical rotor (2).

Selection of either of abovementioned possibilities individually, or all possibilities simultaneously, causes different change of slant of longer axis of mentioned imagined ellipse relative to longitudinal axis of internal space cylindrical rotor (2), or relative to horizontal axis of inner tooth gears (11). That way in all strokes of work cycle, optimal mode of change of displacement of work chamber of radial placed work cylinder (3), may be selected relative to change of angle of rotation of internal space cylindrical rotor (2).

Figure 3:
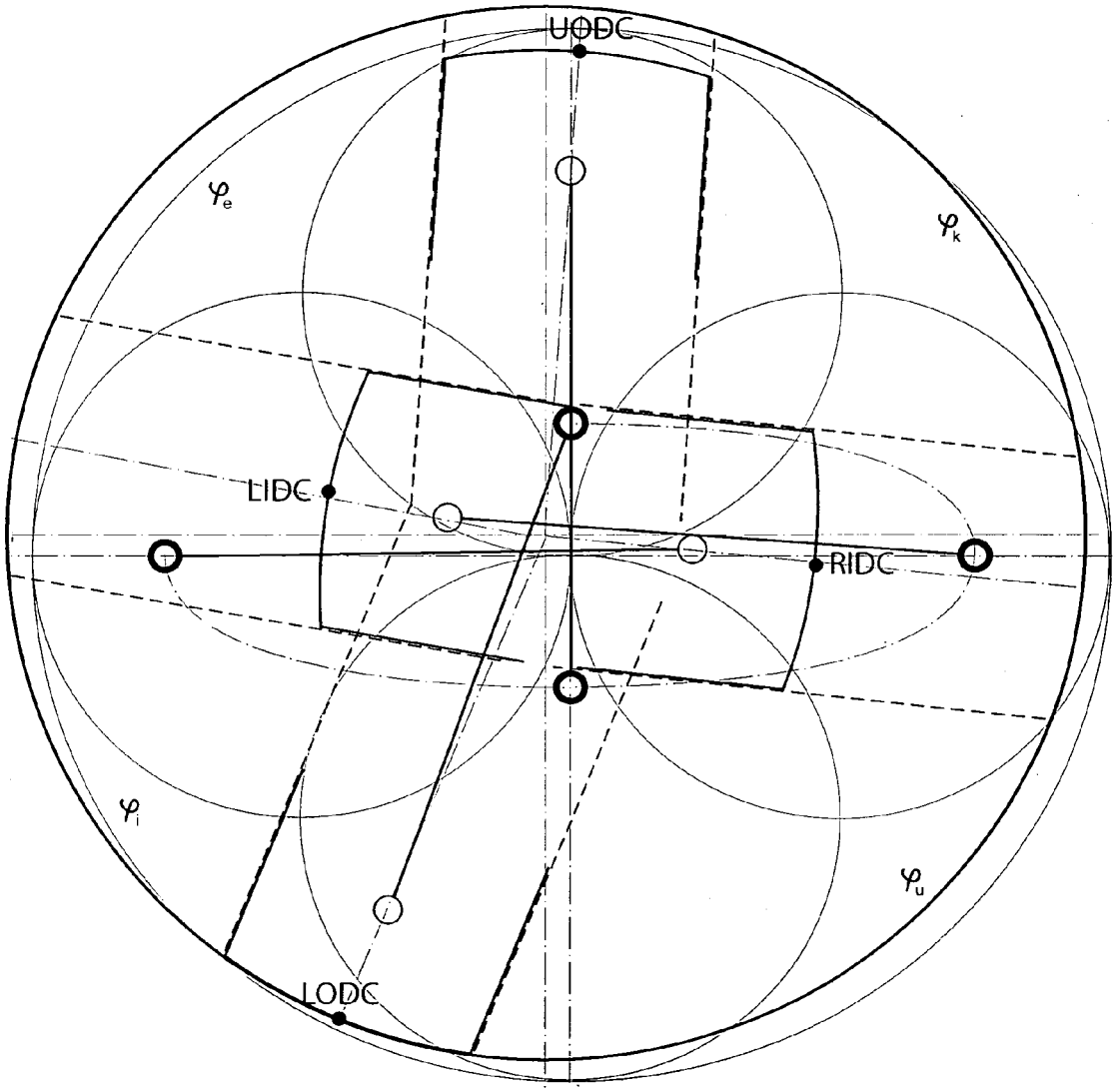
Figure 4:
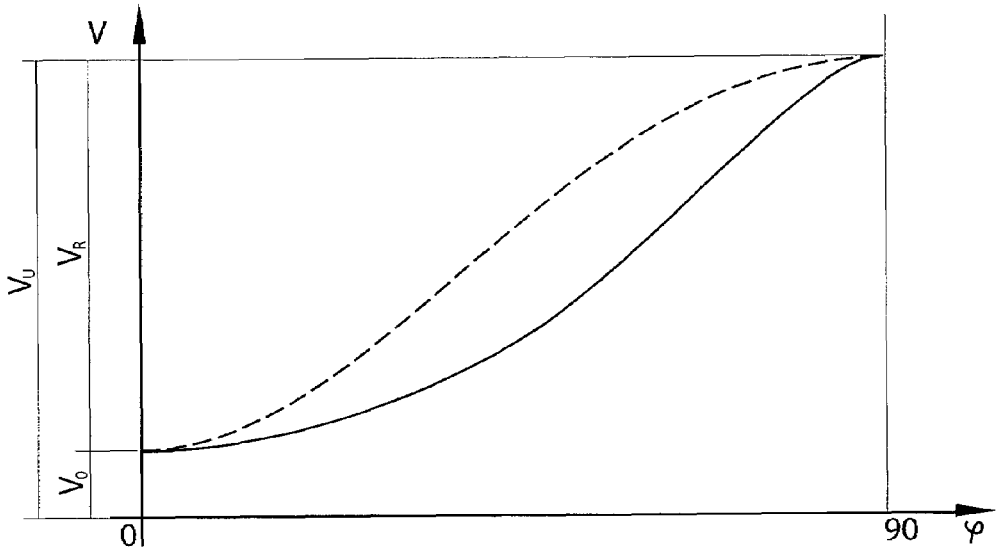
FIG. 4. Shows change of displacement volume as a function of change of angle of rotation of internal space cylindrical rotor with elliptic rotary motor (solid line) and with classical motor (dotted line), where Vo is starting displacement, Vg is working displacement and Vu is total displacement of radial placed work cylinder, and $\phi$ is angle of rotation of internal space cylindrical rotor.
Figure 5:
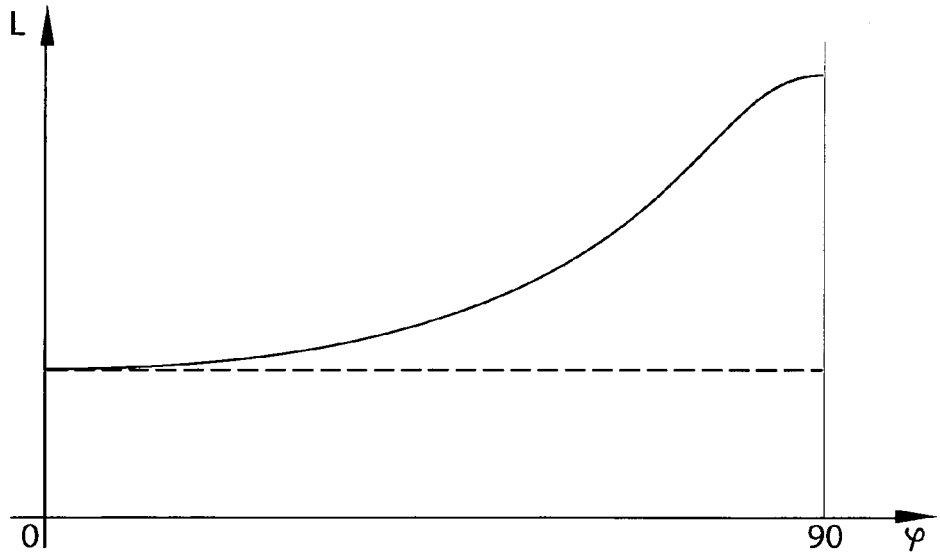
FIG. 5. Shows change of arm of rotation force as a function of change of angle of rotation of internal space cylindrical rotor with elliptical rotary motor (solid line) and with classical motor (dotted line), where "L" is length of arm of rotation force and $\phi$ is angle of rotation of internal space cylindrical rotor.
Figure 6:
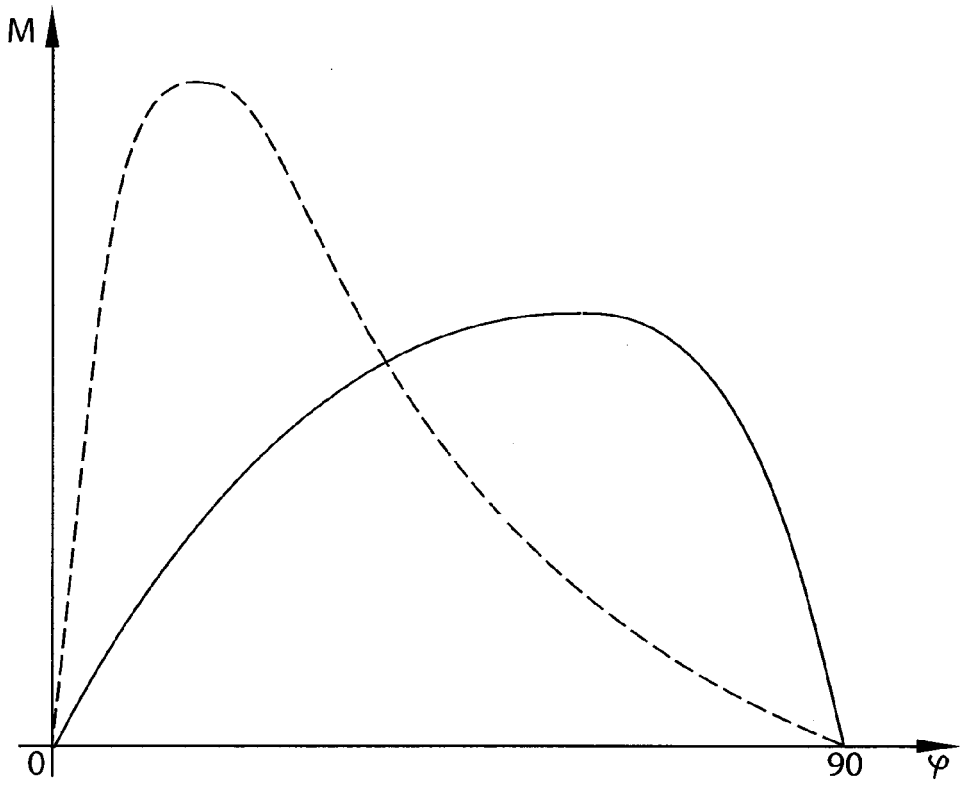
FIG. 6. Shows change of rotary moments as a function of change of angle of rotation of internal space cylindrical rotor with elliptical rotary motor (solid line) and with classical motor (dotted line), where "M" is rotary moment and $\phi$ is angle of rotation of internal space cylindrical rotor.

FIG. 3 shows one of possible selections of different size of angle which occurs between individual strokes of work cycle during rotation of internal space cylindrical rotor (2) of elliptical rotary motor.

Sealing of work chamber of radial placed work cylinder (3) or prevention of leaking of fuel-air mixture or exhaust gases is done by piston rings located in grooves in piston (6) and rings (seals) located in sealant groove (5) in work cylinder cap (4) of radial placed work cylinder (3).

Cooling of elliptic rotary motor is done by coolant circulating thru cooling chambers (21) located in the wall of motor housing (1) and also by oil which is on the inside of motor housing (1) by the action of centrifugal force applied to the moving parts of the elliptical rotary motor.

Connecting of motor housing (1) to inner tooth gears (11) and deck-lids (18) is done by bolts and defining of initial position of motor mechanism and centering of motor housing (1), inner tooth gears (11) and deck-lids (18) is done by centering pin.

Also located in motor housing (1) are opening (19) for regulation sub-pressure and opening (24) for flushing and cooling of the dome of the piston (6).

Elliptical rotary motor is closed on both sides by deck-lids (18) which simultaneously serve as carriers of bearings (22) and swinging bearing rings (13).

Work cycle of elliptical rotary motor begins by moving of piston (6) from LODC towards right inner dead center (RIDC) by the intake stroke in-taking fuel-air mixture (or only air in diesel version of elliptical rotary motor) into work chamber of radial placed work cylinder (3) thru intake port (15) located in the wall of motor housing (1). Intake stroke ends with arrival of piston (6) to the RIDC and continued motion of piston (6) towards UODC begins compression stroke. Ignition of compressed fuel-air mixture (or injection of fuel into compressed air in diesel version) is done by spark of the spark plug (or by injector in diesel version) from spark plug opening (14) of motor housing (1). Moment of ignition (or injection) can happen before piston (6) arrives to UODC, at UODC or after passing of piston (6) thru UODC, depending on selected mode of change of displacement of work chamber of radial placed work cylinder (3) and selected size of angle of rotation of internal space cylindrical rotor (2) in individual strokes of the work cycle. After completed combustion piston (6) due to gas force continues motion towards LIDC when in expansion stroke portion of potential energy of the products of combustion transforms into mechanical work. Expansion stroke ends by arrival of piston (6) to LIDC and immediately after that work chamber of radial placed work cylinder (3) arrives to the exhaust port (16) located in the wall of motor housing (1). Continued motion of piston (6) towards LODC eliminates products of combustion from the work chamber of radial placed work cylinder (3) thru exhaust port (16) simultaneously by outflow due to pressure of the products of combustion in work chamber of radial placed work cylinder (3) and pushing of products of combustion by the dome of piston (6).

The invention claimed is:

1. An elliptical rotary internal combustion motor comprising:

(a) a motor housing (1) having a cylindrical ring shape; said motor housing (1) further comprising:
at least one intake port (15);
at least one spark plug opening (14);
at least one exhaust port (16);
a regulating sub-pressure opening (19);
a flushing and cooling opening (24);
a cooling chamber (21);
wherein said at least one intake port (15); said at least one spark plug opening (14); said at least one exhaust port (16) said regulating sub-pressure opening (19); said flushing and cooling opening (24) and said cooling chamber (21) are positioned on circumference in a vertical plane of symmetry, from each other at distance relative to initial position of a motor mechanism and according to kinematic-geometric characteristics;

(b) an internal space cylindrical rotor (2) rotating within said motor housing (1); said an internal space cylindrical rotor (2) further comprising:
a connecting axle (9);
an oscillating lever (8);
a connecting rod (7);
a satellite gears (12);
swinging bearing rings (13);
internal space cylindrical rotor openings (23, 25);
shafts (17, 20); and
a radial placed work cylinder (3); said radial placed work cylinder (3) further comprising:
a piston (6) having a longitudinal axis being perpendicular to an axis of a center of said elliptical rotary motor; said piston (6) placed inside said radial placed work cylinder (3) connected to connecting rod (7);
a work cylinder cap (4) having on a bottom side flattened surface and a ring shaped groove, being situated on a top side of said radial placed work cylinder (3) for closing said radial placed work cylinder (3), and having sealant grooves (5) on an upper surface to prevent leaking of fuel-air mixture and exhaust gases;
wherein said work cylinder cap (4) has an upper cylinder shaped surface with a radius equal to said internal space cylindrical rotor (2), and in a vertical axis coaxial with a longitudinal axis of said radial placed work cylinder (3) has an opening in the middle of said work cylinder;
wherein said piston (6) includes a dome shape matching an inner portion of said work cylinder cap (4), at least one groove for piston rings and moves cyclically as said internal space cylindrical rotor (2) rotates;
wherein said internal space cylindrical rotor (2), which is cylinder shaped, has an opening on an upper portion for receiving said radial placed work cylinder (3) having a longitudinal axis being perpendicular to the longitudinal axis of said internal space cylindrical rotor (2), and openings to the left and to the right side of said radial placed work cylinder (3) for cooling; and has an opening on lower portion of said internal space cylindrical rotor (2) for receiving said satellite gears (12), said connecting axle (9), said oscillating lever (8) and said connecting rod (7); and
wherein on the top side of said opening of said radial placed work cylinder (3), being perpendicular to the axis of said radial placed work cylinder (3), said flattened surface is for receiving said work cylinder cap (4) to close said radial placed work cylinder (3);

(c) inner tooth gears (11) being on lateral sides of said motor housing (1);
wherein said connecting axle (9) connected said oscillating lever (8) and said connecting rod (7), is positioned in said opening on said lower portion of said internal space cylindrical rotor (2), under said radial placed work cylinder (3);
wherein said connecting axle (9) is with both ends connected to said satellite gears (12) such that every point on a longitudinal axis of said connecting axle (9) during rotation of said internal space cylindrical rotor (2) moves cyclically along imagined closed ellipse curve defining mode of change of displacement of said work chamber of said radial placed work cylinder (3) as a function of change of angle of rotation of said internal space cylindrical rotor (2);
wherein said connecting rod (7) and said oscillating lever (8) are connected via needle bearing at a central portion of said connecting axle (9);
wherein said oscillating lever (8) is shackingly connected to said connecting axle (9) on the left and on the right side of said connecting rod (7) on one end, and on the other end, said oscillating lever (8) has a pin (10) connected to the internal space cylindrical rotor opening (23);
wherein a distance between centers of openings of said oscillating lever (8) defines a slant of said imagined ellipse, a change of displacement of work chamber of said radial placed work cylinder (3), a different duration of work strokes, and simultaneously defines a starting position of motor mechanism;
wherein said satellite gears (12) are placed in said lower portion of said opening of said internal space cylindrical rotor (2) where said satellite gears (12) have, on the lateral sides, an opening located outside of the centers and an abeam tooth profile axis of their teeth, where position of said openings defines displacement of work chamber of the said elliptical rotary motor with internal combustion and where said openings serve for connection between said satellite gears (12) via said connecting axle (9) so said satellite gears (12) are parallel connected in position towards each other as in mirror image at distance which is sufficient for placement of said oscillating lever (8) and said connecting rod (7);

wherein said satellite gears (12) have in centers of the lateral sides an opening suited for resting on sleeve of said swinging bearing rings (13) where said swinging bearing rings (13) make possible rotation of said satellite gears (12) around their own axis and dictate that during rotation of said internal space cylindrical rotor (2);

wherein said satellite gears (12) cyclically oscillate relative to rotating of said longitudinal axis of said radial placed work cylinder (3) to define a position of said internal space cylindrical rotor (2) and said radial placed work cylinder (3) and length of stroke of said piston (6) relative to said motor housing (1);

wherein said shafts (17, 20) of said internal space cylindrical rotor (2), being on the lateral sides of said radial placed work cylinder (3) are coaxial with the longitudinal axis and form integral said internal space cylindrical rotor (2);

wherein said internal space cylindrical rotor openings (23, 25) have a position relative to the center of rotation to define mode of change of displacement in said radial placed work cylinder (3) during work cycle;

wherein said inner tooth gears (11) are fastened to said motor housing (1) having center of pitch diameter offset relative to said longitudinal axis of said motor housing (1) by the horizontal and vertical eccentricity and wherein said inner tooth gears (11) are geared in the ratio i=2 to said satellite gears (12) to define kinematic-geometric characteristics of said motor mechanism; and d) deck-lids (18);

wherein said swinging bearing rings (13) have a ring shape with an inner diameter for mounting on said deck-lids (18); sleeves are relative to the centers and positioned at the distance corresponding to a base half diameter of said satellite gears (12);

wherein said longitudinal axis of said swinging bearing rings (13) is parallel to the axis of said sleeves which carry said satellite gears (12), and assures a simultaneous rotating and oscillating motion;

wherein said deck-lids (18) at the centers have openings for bearings of said shaft (17) and said shaft (20) of said internal space cylindrical rotor (2);

wherein said deck-lids (18) on inner sides have eccentrically situated hubs, whose longitudinal axes are offset relatively to said longitudinal axis by the horizontal and vertical eccentricity as with said inner tooth gears (11); and wherein said swinging bearing rings (13) positioned on said deck-lids (18) define a circular trajectory of said satellite gears (12).

2. The elliptical rotary internal combustion motor according to claim 1 said motor housing (1) further comprising a fuel injector positioned in at least one opening (14) when said elliptical rotary internal combustion motor with internal combustion is a diesel internal combustion motor.

3. The elliptical rotary internal combustion motor according to claim 1, wherein n interconnected elliptic rotary internal combustion motors, serially connected in said axis of rotation of said internal space cylindrical rotor (2) and said longitudinal axis of said radial placed work cylinder (3) phase offset by angle 360/n.

* * * * *